US005359874A

United States Patent [19]

Buckley et al.

[11] Patent Number: 5,359,874

[45] Date of Patent: Nov. 1, 1994

[54] METHOD AND APPARATUS FOR PRODUCTION OF CONTINUOUS METAL STRIP

[75] Inventors: Richard D. Buckley, Watkinsville, Ga.; Thomas L. Linsenbardt, Lohman, Mo.; Harold Younger, Halifax, Va.; Darrell D. Harris, Fulton; Dennis J. Struemph, Mea, both of Mo.

[73] Assignee: ABB Power T & D Company, Inc., Blue Bell, Pa.

[21] Appl. No.: 791,103

[22] Filed: Nov. 12, 1991

[51] Int. Cl.[5] ..... B21C 23/06

[52] U.S. Cl. ..... 72/256; 72/262

[58] Field of Search ..... 72/176, 256, 262, 264, 72/269

[56] References Cited

U.S. PATENT DOCUMENTS

| | | | |
|---|---|---|---|
| 1,423,361 | 7/1922 | Rockwell | 72/256 |
| 1,811,374 | 6/1931 | Watkins | 72/176 |
| 2,133,874 | 10/1938 | Sparks | 72/256 |
| 4,564,347 | 1/1986 | Vaughan | 72/262 |
| 4,823,586 | 4/1989 | Sinha et al. | 72/262 |

*Primary Examiner*—Lowell A. Larson

*Attorney, Agent, or Firm*—Ostrolenk, Faber, Gerb & Soffen

[57] ABSTRACT

Twin metal billets are fed to dual circumferential grooves formed in a rotating wheel. The billets are advanced first to a wedge-shaped gap which deforms the billets and are then advanced to a die. The die has a die opening with a circumferentially discontinuous, annular cross-section. The metal from each billet merges in the die opening and exits therefrom in the form of a slit tube. The tube is then opened and flattened to form a flat strip by advancing the slit tube over a forming member having a progressively increasing width.

20 Claims, 11 Drawing Sheets

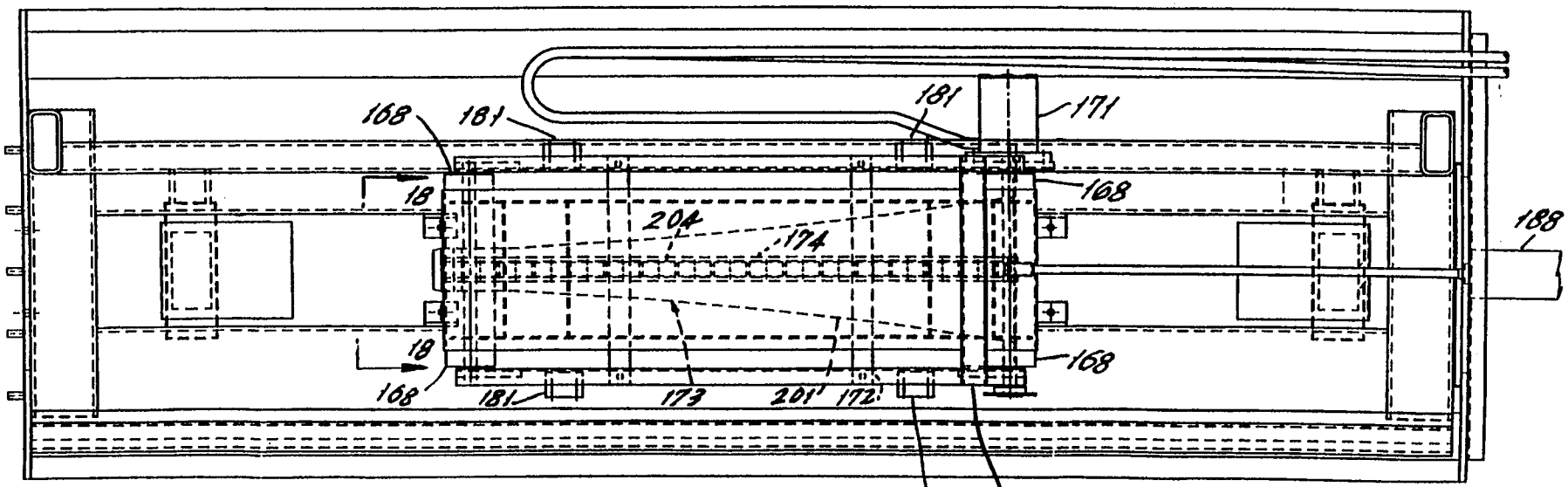
FIG. 17
FIG. 18
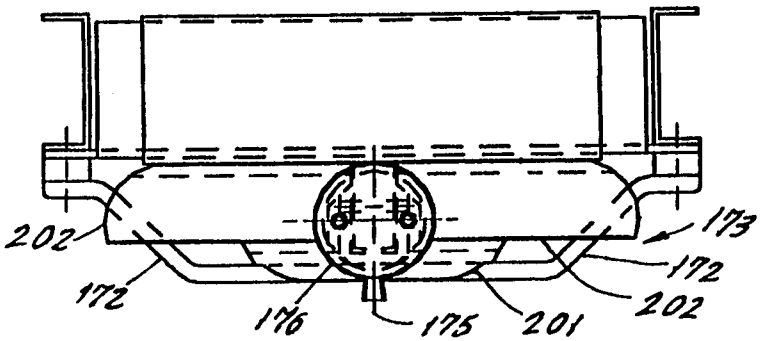

METHOD AND APPARATUS FOR PRODUCTION OF CONTINUOUS METAL STRIP

BACKGROUND OF THE INVENTION

This invention relates to the production of metal strips and, more particularly, to the production of metal strips suitable for use in the coils of power transformers.

Power transformers, such as overhead distribution transformers and pad mounted distribution transformers, generally include coils which are wound from relatively wide strips of aluminum. In order to provide the requisite electrical characteristics for such transformers, it is necessary that the aluminum strips not only have accurate dimensions, but also have other desired characteristics, such as a desired electrical conductivity and 0-temper.

Heretofore, the aluminum strips have been produced by first casting aluminum into ingots and then cold rolling and hot rolling the ingots to form sheets which are then slit to form the strips. In addition, the strips have been subjected to secondary metal treating processes to contour the edges thereof. Contoured edges enable the strips to be insulated with a dielectric in an optimal manner.

While the foregoing processing has produced satisfactory strips, because of the number of steps involved, it is relatively costly. Accordingly, a continuous process minimizing the number of discreet steps is desirable. In this connection, consideration has been given to conventional extrusion processes. However, such conventional extrusion does not permit the continuous processing that is desired in connection with the production of flat metal strips for power transformer coils.

SUMMARY OF THE INVENTION

Accordingly, the principal object of this invention is to provide a new and improved method and apparatus, employing continuous extrusion, to continuously form flat metal strips suitable for producing coils for power transformers.

In accordance with the present invention, the foregoing, as well as other objects, are achieved by feeding first and second continuous rod-like billets through first and second circular grooves formed respectively in a rotating wheel. The first and second billets are advanced by the rotating wheel through a passageway formed between the wheel and a stationary shoe. The billets are advanced by the rotating wheel to first and second abutments positioned to enter the first and second grooves, respectively. The abutments block movement of the billets through the passageway, the billets thereby being plastically deformed and forced out of the grooves to an opening in a die positioned adjacent to the wheel. The deformed first and second billets merge within the die opening which has a circumferentially discontinuous, annular cross sectional shape, and exit therefrom in the form of a slit tube. The tube is then advanced to a forming station at which the tube is opened and flattened by bending it outwardly in opposite directions at the slit.

In accordance with an aspect of the present invention, an elongated forming member and an opposing surface are provided for opening and flattening the tube. The elongated forming member has an entrance end and an exit end. The entrance end has a width equal to or less than the diameter of the tube, the width progressively increasing from the entrance end toward the exit end of the forming member. Preferably, the opposing surface is flat and in a preferred embodiment is a flat moving belt. The tube is advanced over the forming member and against the flat surface such that the forming member opens the tube from the slit outwardly and forms the tube into a substantially flat strip.

The objects, advantages, and features of the present invention will be better understood from the following detailed description when considered in connection with the appended drawings in which:

BRIEF DESCRIPTION OF DRAWINGS

FIGS. 16 and 17 are respectively a side elevational view and a top plan view of an alternative embodiment of an opening and flattening station;

FIG. 18 is an end, elevational view, taken along the line 18—18 of FIG. 16.

DETAILED DESCRIPTION

Figure 1:
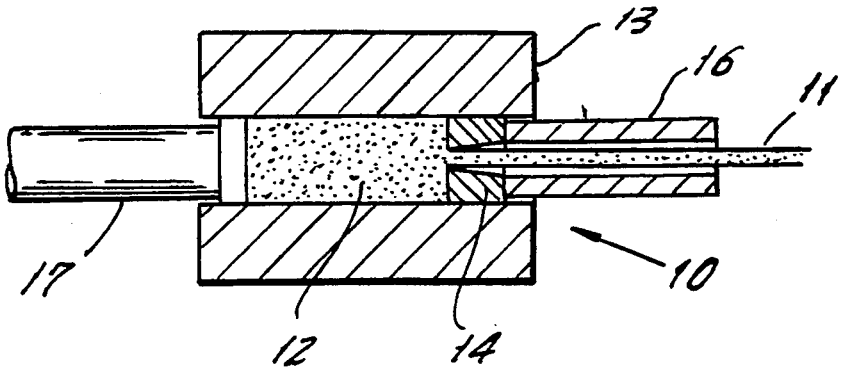
FIG. 1 is a cross-sectional elevation view of a conventional extrusion apparatus.

Referring now to the drawings and, in particular, to FIG. 1, there is shown a conventional extrusion apparatus 10 for extruding a product 11 from a billet 12. The apparatus 10 includes a housing 13, a die 14 and a die stem 16. As is conventional, the billet is driven against the die by a punch 17. As the punch 17 advances, it deforms the billet 12 and extrudes it through the die 14 and die stem 16 to form the product 11. Because of the friction existing between the billet 12 and the housing 13, the force required to commence extrusion limits the length of billets to about five times their diameter. This, therefore, puts a limit on the amount of material that may be extruded at any one time and prevents this type of extrusion from being continuous.

Figure 2:
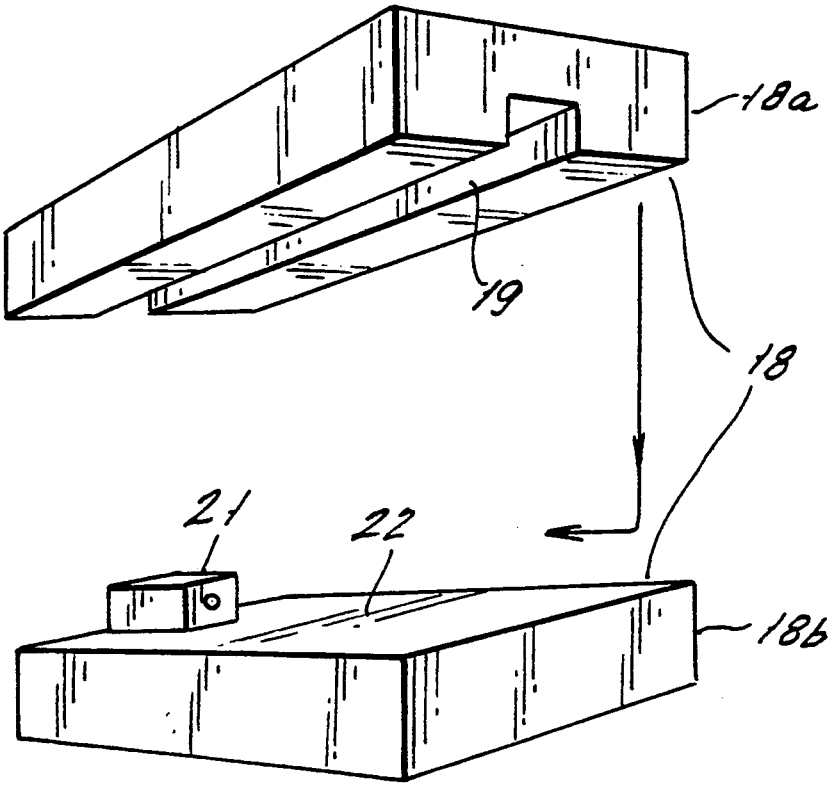
FIG. 2 is a diagrammatic representation of a continuous extrusion process known as the Conform process.

To overcome this problem, the Conform process has been developed in which friction is used to advantage. Referring now to FIG. 2, there is shown diagrammatically an apparatus illustrating the Conform process. As seen in FIG. 2, the conventional housing is replaced by a split housing 18 of rectangular cross section. An upper part 18*a* of the housing 18 has a rectangular cross section groove 19 into which is loaded a tightly fitting rectangular billet (not shown); a lower part 18*b* of the housing holds a die 21 which blocks one end of the groove 21. On movement of the upper part 18*a* of the housing 18 towards the die 21, friction between the billet and the three sides of the groove 21 act to push the billet forwardly against the die. Similarly, the friction between the billet and the top surface 22 of the lower part 18*b* of the housing 18 act to oppose such forward motion. The net force, equivalent to the friction between the billet and two sides of the groove 19, will be directed to driving the billet against the die 21.

Figure 3A:
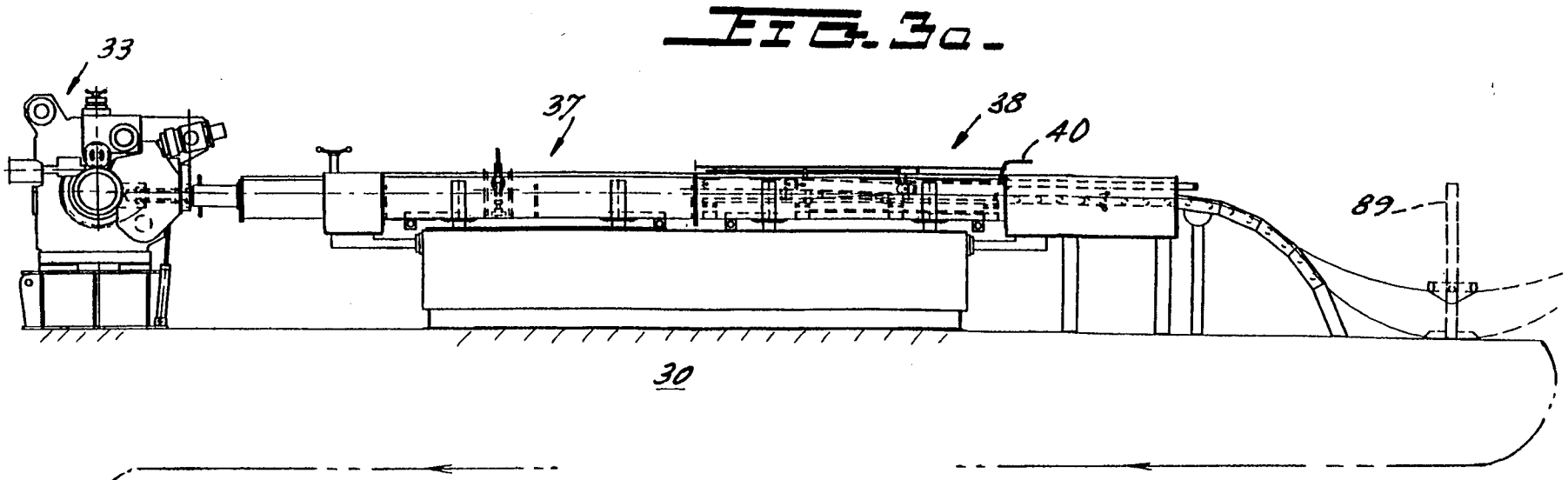
FIG. 3A and FIG. 3B together, with FIG. 3B to the right of FIG. 3A, illustrate apparatus in accordance with the invention for forming flat strips from metal billets.
Figure 3B:
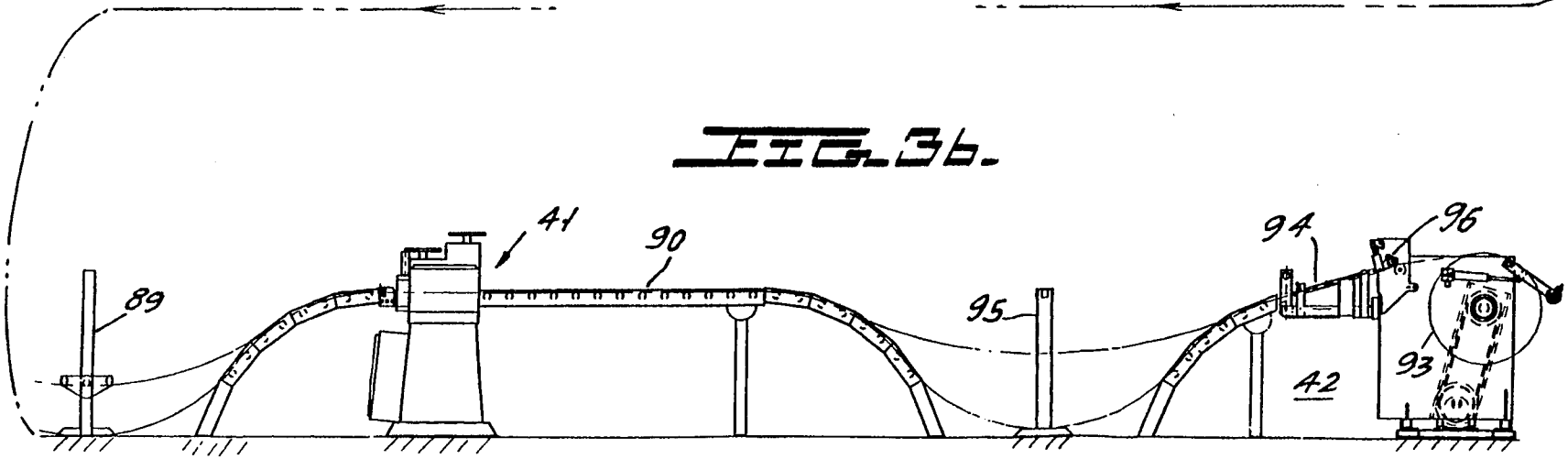
Figure 5:
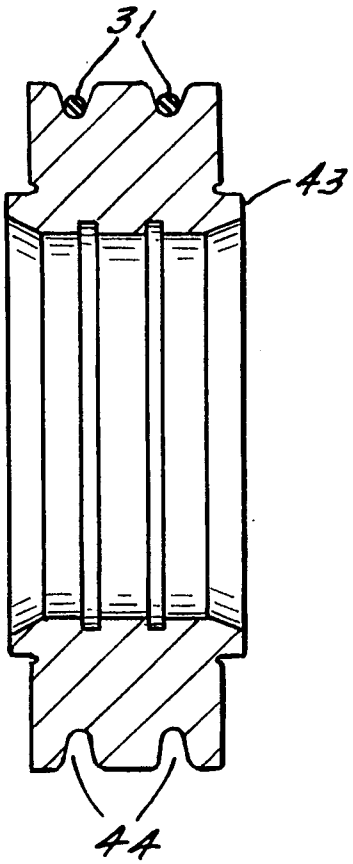
FIG. 5 is a plan view of a wheel used in the Conform extruder of FIG. 4.
Figure 13:
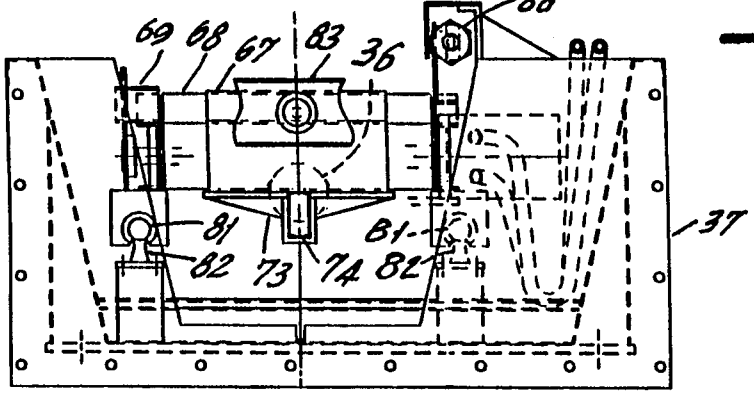
FIG. 13 is an end elevational view, taken along the line 13—13 of FIG. 12.

Turning now to FIGS. 3A and 3B, there is shown apparatus 30 illustrating certain principles of the invention in which the Conform process has been adapted to continuously form first and second metal billets 31 (FIG. 5) into a flat strip suitable for forming a power transformer coil 32 (FIG. 13).

Figure 9:
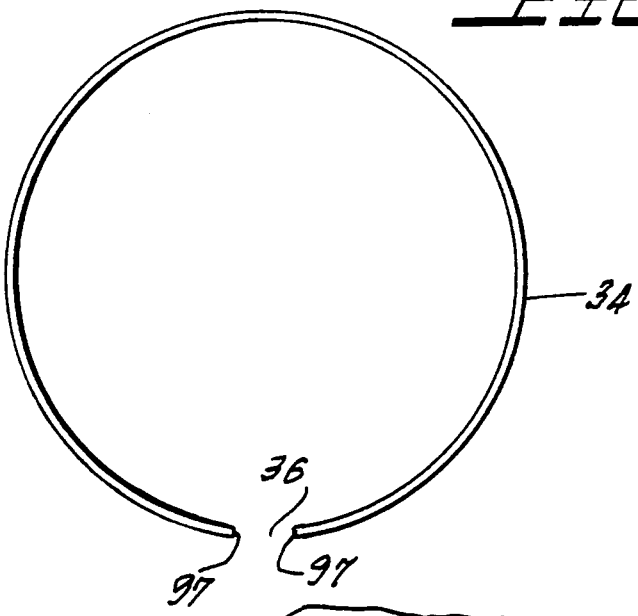
FIG. 9 is a cross-sectional view of the tube after exiting the Conform extruder.
Figure 11:
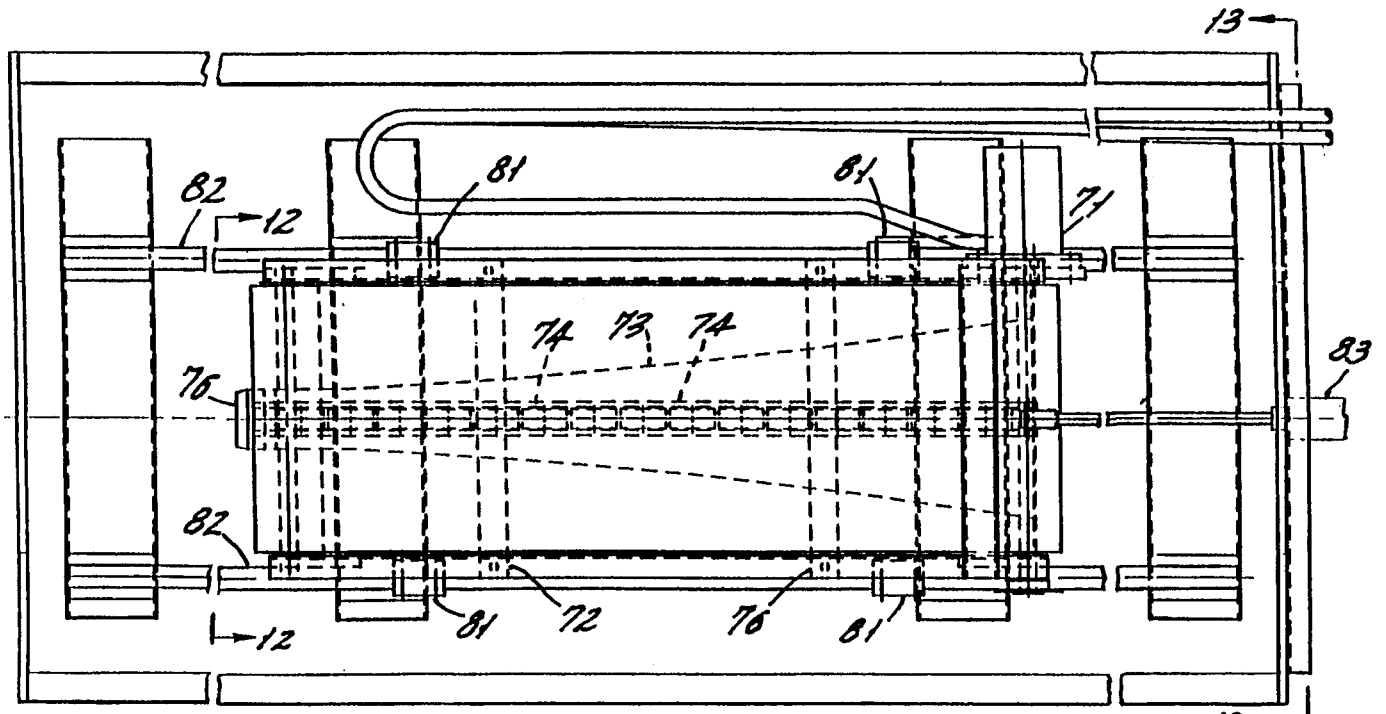
Figure 12:
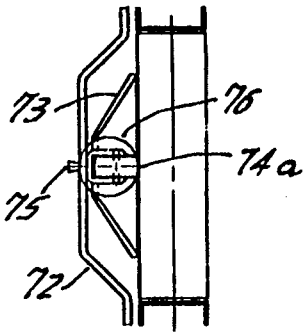
FIG. 12 is an end elevational view, taken along the line 12—12 of FIG. 11.

The apparatus 30 includes a Conform extruder 33 which forms the first and second billets 31 into a tube 34 having a slit 36 (FIG. 9). After exiting from the Conform extruder 33 the tube 34 is advanced into a cooling chamber 37 and then to an opening and flattening unit 38 in which the tube is formed into a flat strip 39 (FIG. 11). The flat strip 39 is then advanced to a leveller 41 which functions to complete the flattening of the strip 39 and smooth out any unevenness so that the strip 39 as it exits the leveller 41 is substantially flat. The strip 39 is then wound upon a mandrel 93 by a take-up system 42.

Figure 4:
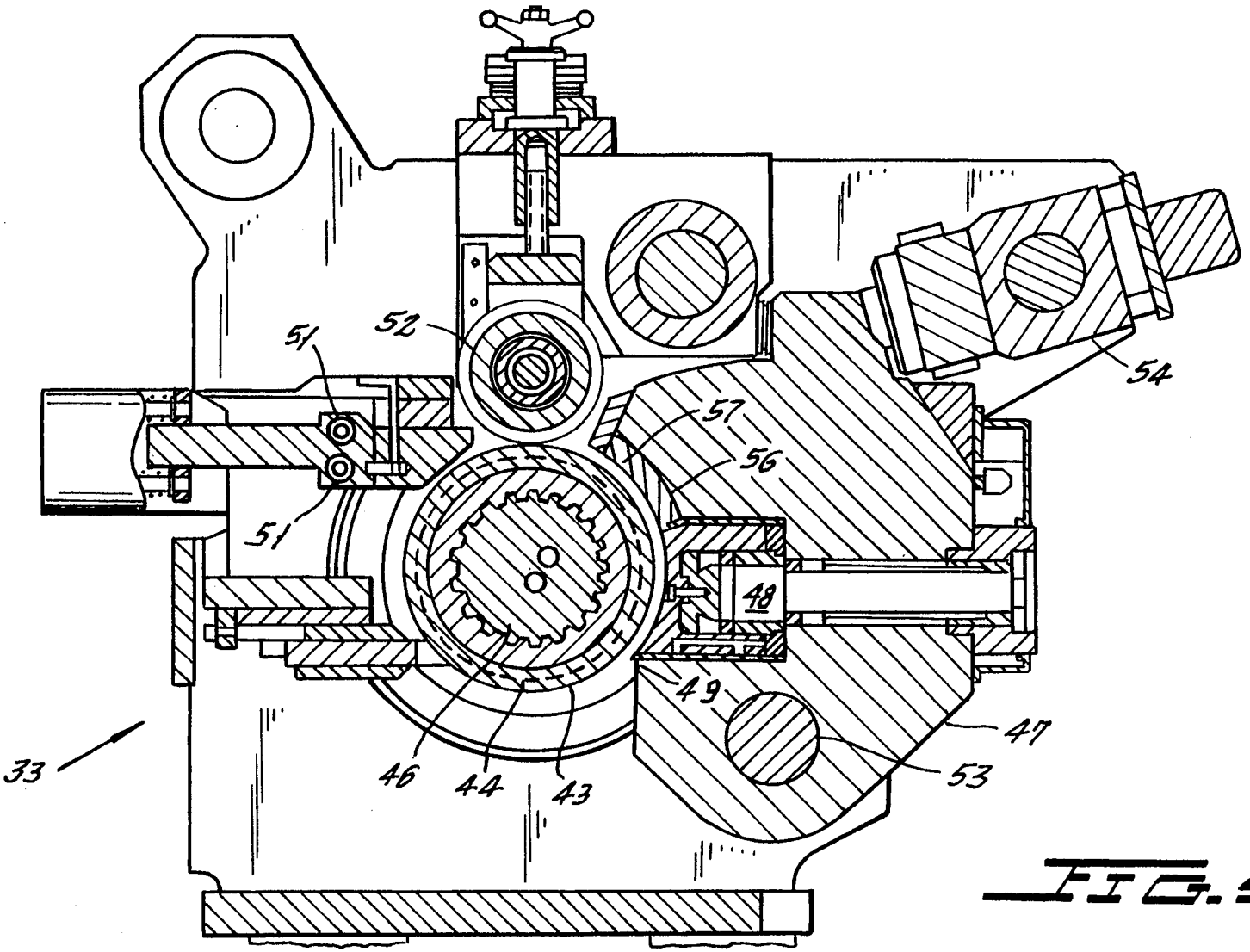
FIG. 4 is a cross-sectional side elevation view of a Conform extruder used in the apparatus of FIGS. 3A and 3B to form the billets into a tube.
Figure 6:
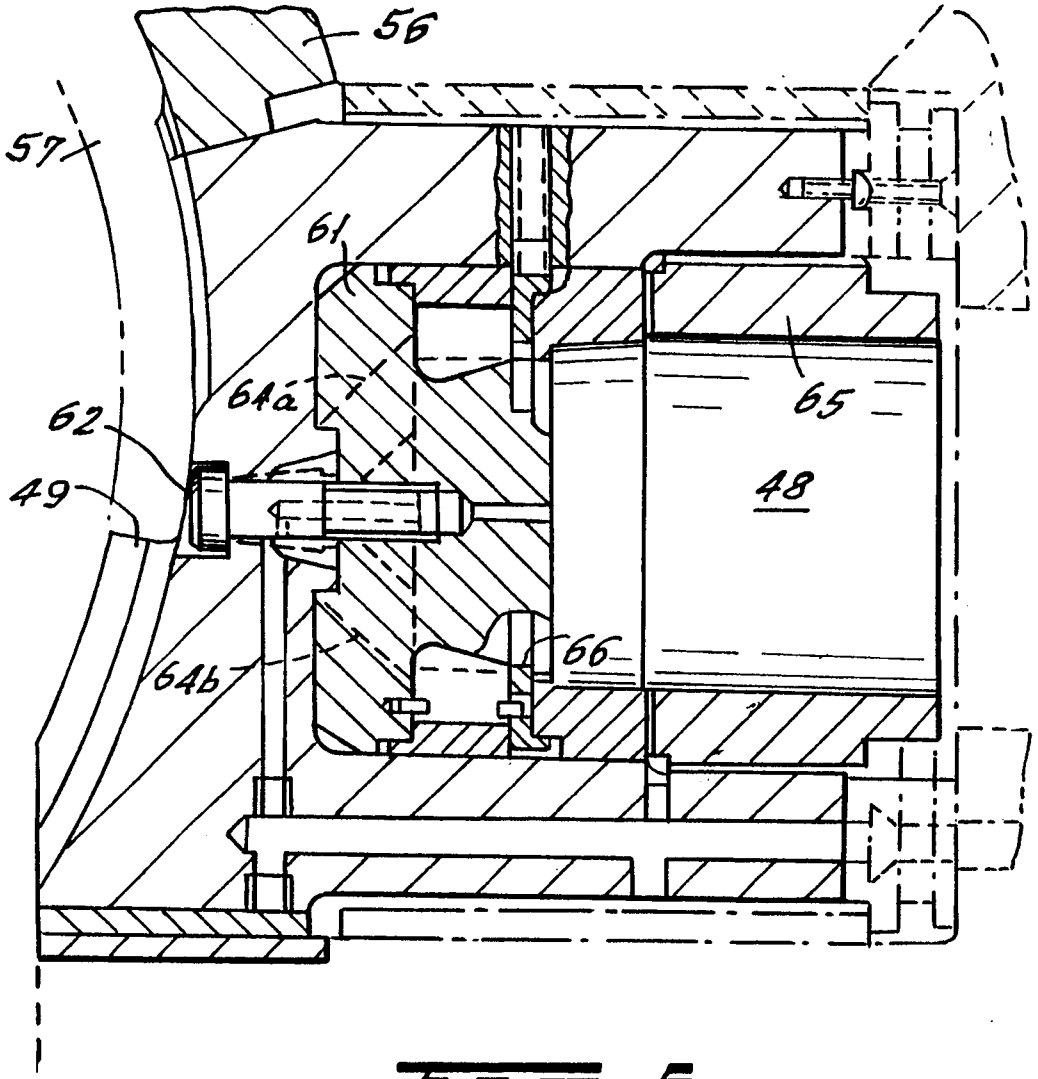
FIG. 6 is a cross-sectional side elevation view of extrusion tooling used in the Conform extruder of FIG. 4.

Referring now to FIG. 4, there is shown a more detailed view of the Conform extruder 33 which may be a conventional continuous Conform extruder available from BWE Ltd., model Twin Groove 350 or 550. The Conform extruder 33 includes a wheel 43 having a pair of circumferential grooves 44 (best seen in FIG. 5) for receiving the first and second billets 31 which advantageously may each be in the form of 0.5 inch diameter aluminum rod. The wheel 43 is mounted for rotation on a splined drive shaft 46 driven by suitable means not shown. The extruder 33 also includes a shoe 47 for holding extrusion tooling 48, the shoe having a pair of abutments 49 (only one of which is shown and is best seen in FIG. 6), which respectively project into the grooves 44 in close proximity to their bottom surfaces. The billets 31 are fed to the wheel 43 through guide rolls 51 and are forced against the Conform wheel 43 by means of a coining roll 52 which is pressure loaded to apply sufficient pressure to the billets 31 as they pass beneath the coining roll 52 so as to facilitate contact with the walls of the grooves 44. The shoe 47 is mounted on a pivot 53 to enable the shoe 47 to be pivoted away from the wheel 43 so that the extrusion tooling 48 may be positioned therein. After the extrusion tooling 48 is positioned, the shoe 47 is pivoted back into its position adjacent the wheel 43. A clamp jack 54 is provided to lock the shoe 47 in this latter position. The shoe 47 also includes an entry block 56 which defines a passageway 57 between the wheel 43 and the inner surface of the entry block 56. The passageway 57 has a wide entrance opening sufficient to accommodate the billets 31 as they initially enter the passageway. The passageway 57 then narrows down at which point frictional forces develop between the billets 31 and the walls of the grooves 44 and between the billets 31 and the inner surface of the entrance block 56. These frictional forces cause the billets to be driven against the abutments 49 and into respective die openings 64 formed in the extrusion tooling 48.

Figure 7:
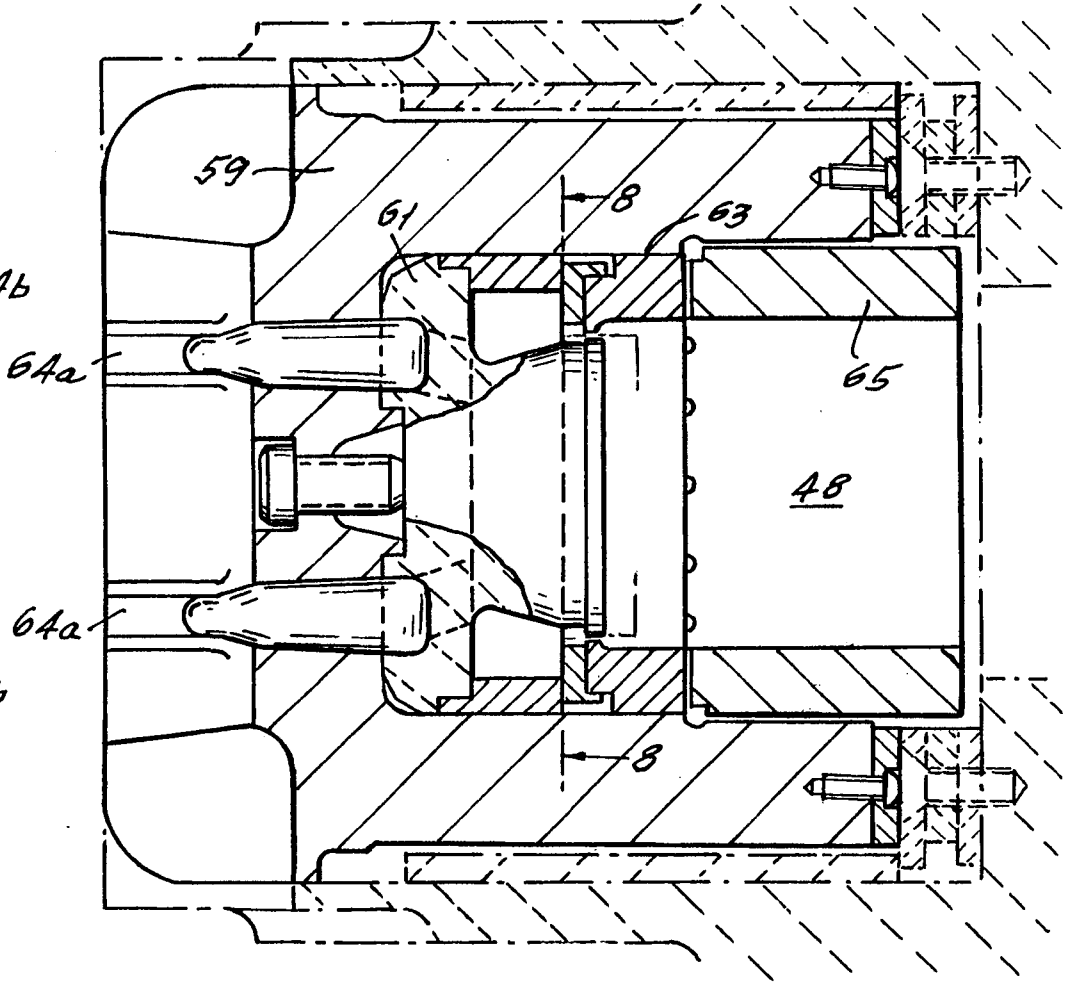
FIG. 7 is a cross-sectional plan view of the extrusion tooling.
Figure 8:
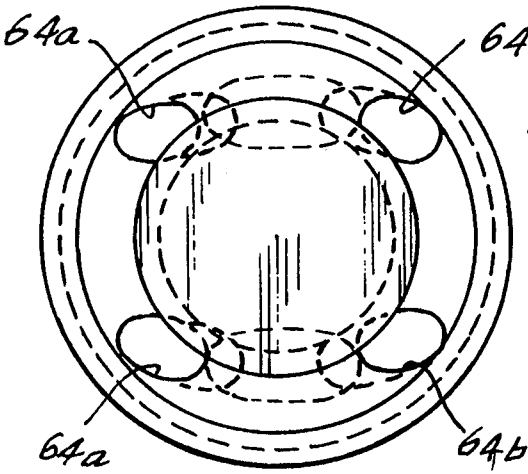
FIG. 8 is a cross-sectional view taken along the lines 8—8 of FIG. 7.

Referring to FIGS. 6–8, the extrusion tooling 48 includes a support 59, a mandrel 61 and a die 63. The mandrel 61 is connected to the support by a screw 62 and the die 63 is secured by an internal nut 65. Each die opening 64 branches into two paths, one path 64*a* directed upwardly and one path 64*b* downwardly. The deformed billet material flows about the mandrel 61 from each pair of openings 64*a* and 64*b* associated with each billet 31, and is extruded about the mandrel 61 and formed into the tube 34 with the slit 36 (FIG. 9). The slit 36 is formed by closing off the flow of material around a portion of the mandrel 61 by, for example, creating an overlay between the mandrel 61 and a plurality of sizing plates 66. In lieu of using the plurality of sizing plates 66 to close off the opening between the mandrel 61 and the die 63 to form the slit 36, a single flat plate (not shown) having a C-shaped slot formed therein by electrical discharge machining, for example, may be employed to perform the same function.

The amount of overlay between the mandrel 61 and the sizing plates 66 determining the width of the slit 36 which, in turn, for a tube 34 of a given diameter determines the width of the strip 39. To produce a strip 39 of a different width, the diameter of the tube 34 is kept constant and the width of the slit 36 is adjusted to achieve the new strip width.

The metal from each billet 31 fills its corresponding openings 64*a* and 64*b* equally as the metal proceeds through the openings and exits from the die unit 48. The use of two openings 64*a* and 64*b* for each billet 31 facilitates the passage of the metal around the mandrel 61. The metal exits the die unit 44 in the form of the tube 34 having the slit 36. Referring back to FIG. 3A, after exiting from the Conform extruder 33, the tube 34 passes into the cooling chamber 37 in which a suitable cooling fluid, such as filtered water, is circulated or sprayed by suitable means (not shown) to lower the temperature of the tube 36 from the high temperature of extrusion to a lower temperature suitable for handling of the tube.

The tube 34 then passes into the opening and flattening unit 38 which is located in the exit end of the cooling chamber 37. Placing the opening and flattening unit 38 in the cooling chamber 37 allows the opening and flattening of the tube 34 to be done under water or with a water spray so that the water will act as a lubricant.

Figure 15:
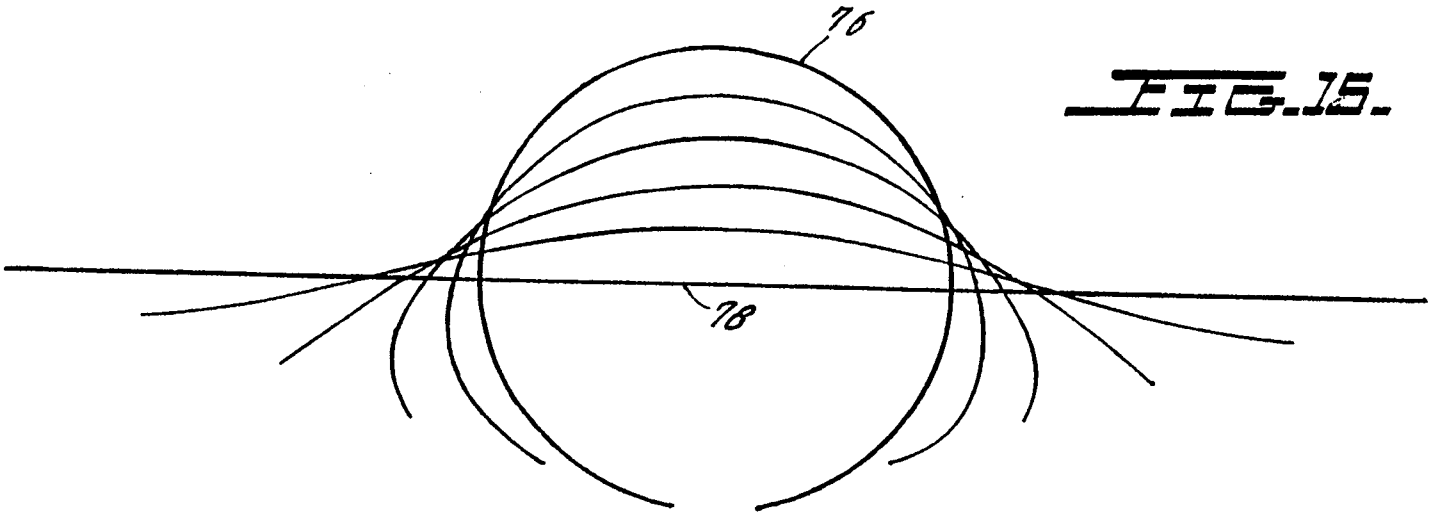
FIG. 15 is a diagrammatic view showing how the cross-section of a shoe used in the opening and flattening station transitions from the entrance end to the exit end of the shoe.

Referring now to FIGS. 10–15, the opening and flattening unit 38 comprises a wide flat belt 67 supported on two sets of pulleys 68 mounted in an aluminum frame 69 and driven by an hydraulic motor 71. Mounted under the frame 69 by brackets 72 is a forming member or shoe 73 which is preferably made of an ultra-high molecular weight plastic, such as ultra-high molecular weight polyethylene, or other low friction material. The shoe 73 is somewhat conically shaped and is split down the center, with a row of pressure rollers 74 mounted along the longitudinal axis thereof. The brackets 72 mount the shoe 73 and rollers 74 to the frame 69 such that the shoe 73 and rollers 74 are pressed upwards against the flat belt 67. The shape of the shoe 73 and its length must be chosen properly so that little if any deformation is produced in the material of tube 34 as the tube transitions from a circular cross section to a flat cross-section during the opening. Preferably the upper working surface has a contour which transitions as shown in FIG. 15 from circular to flat. More specifically, the entrance end or nose 76 of shoe 73 has a height and width substantially equal to the diameter D of the tube 34, the width of the shoe progressively increasing from the entrance end 76 to the exit end 78 thereof. The height decreases until the cross-section of the shoe 73 at the exit end 78 is flat and is at the longitudinal axis of the shoe which is coaxial with the longitudinal axis of the tube 34. The width increases until it is equal to the circumference of the tube 34.

In operation, the leading end of the split tube 34 is inserted into the opening and flattening unit 38 with the slit 36 at the bottom between the belt 67 and the first pressure roller 74*a*. The belt 67 and the first pressure roller 74 cooperate to grip the leading end of the tube 34 and pull the tube across the shoe 73. The nose 76 has a guide finger 75 which projects into the slit 36 to guide the tube 34 over the shoe 73. As the tube 34 is pulled across the shoe 73, the shoe 73 causes the tube 34 to spread until an almost flat strip 39 leaves the opening and flattening unit 38.

Figure 10:
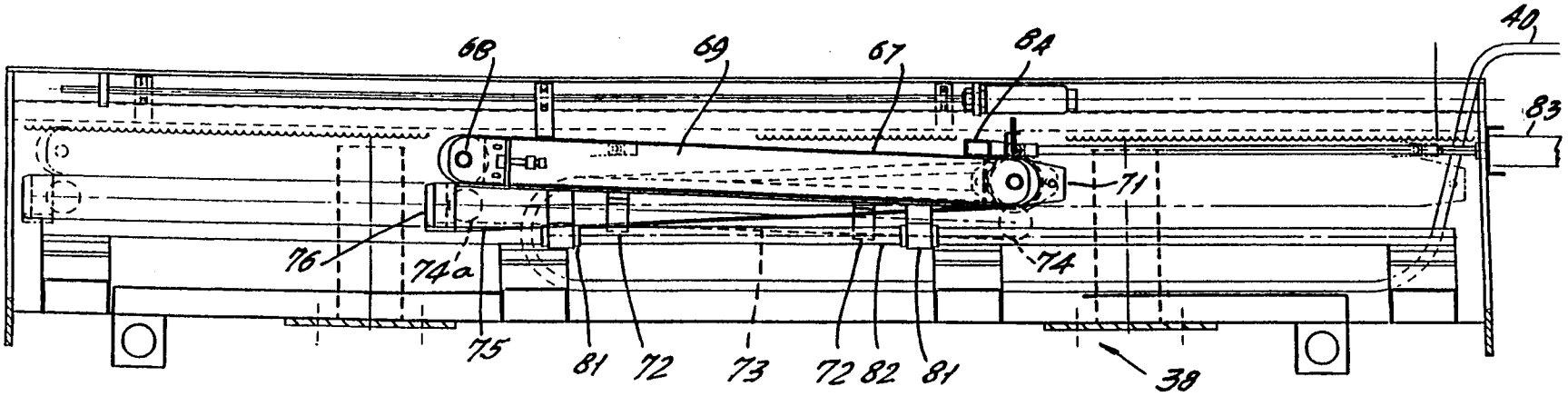
FIGS. 10 and 11 are respectively a side elevational view and a top plan view of a first embodiment of an opening and flattening station for opening and flattening the tube to form the tube into a flat strip.

The opening and flattening unit 38 is arranged for linear movement toward and away from the Conform extruder 33, as shown by the phantom lines in FIG. 10. More specifically, the opening and flattening unit 38 is mounted on linear bearings 81 which, in turn, are mounted on a pair of spaced longitudinally extending rods 82. The capability of the opening and flattening unit 38 to move capability of the opening and flattening unit 38 to move to and fro enables the unit to accommodate variations in the speed of the tube 34 which are inherent in the extrusion process. While the opening and flattening unit 38 is moving to and fro, an air cylinder 83 connected to a tension bar 84 mounted across the width of the frame 69, applies a force to the belt in the same direction as the extrusion direction. This force, which is applied across the width of the belt by the tension bar 84, acts to keep tension in the tube 36 as constant as possible. Constant tension in the tube 36, in turn, tends to keep the tube straight and the cross-section constant. The air pressure applied to the air cylinder 83 is regulated to accomplish the constant tension.

The speed of the belt 67 must be matched to the speed of the extrusion. This may advantageously be accomplished by an electronic speed controller (not shown) which uses the outputs from a pulse tachometer roller 87 in contact with the tube 34 and a linear transducer 88 mounted along the travel of the opener assembly. The speed controller adjusts the speed of the hydraulic motor 71 to keep the opening and flattening unit 38 centered as much as possible in its travel. As the opening and flattening unit 38 tends move away from the Conform extruder 33, the speed of the belt 67 will be increased and when it moves toward the Conform extruder its speed will be decreased. The control parameters are selected such that variation in extrusion speed is compensated by to and fro movement of the opening and flattening station 38 about the midpoint of its travel under loading of the tension bar 84.

An alternative embodiment 138 of an opening and flattening unit is shown in FIGS. 16 through 19. Components of the opening and flattening unit 138 are all designated by three digit reference numerals with those major components which are the same as or have the same function as major components of the opening and flattening unit 38 having a 1 as the first digit and having the same last two digits as the reference numerals of the major components of the opening and flattening unit 38; other components of the opening and flattening unit 138 have a three digit reference numeral beginning with 2.

The opening and flattening unit 138 comprises a wide flat belt 167 supported by two sets of pulleys 168 mounted in an aluminum frame 169 and driven by an hydraulic motor 171. Mounted onto the frame 169 by brackets 172 is a shoe 173. The shoe 173 includes a nose 76, guide fingers 175 and a pair of upper spreading members 201, a lower spreading member 202, channel member 203 to which rollers 174 are rotatably mounted and a pair of support plates 204. The support plates 204 are keyed to the channel 203 and the upper spreading members 201 are connected to the support plates by suitable fasteners (not shown). The lower spreading member 202 is connected to the channel member 203 by suitable fasteners (not shown). The brackets 172 mount the channel member 203, and hence the shoe 173, to the frame 169 so that the shoe 173 and rollers 174 are pressed upwards against the flat belt 167. The upper spreading members 201 and the lower spreading member 202 are contoured such that they progressively increase in width from the nose 176 towards the exit end of the opening and flattening station 138. Additionally, both the upper spreading members 201 and the lower spreading member 202 have arcuate cross sections so that the combination approximates the shape of the conical shoe 73 of the first embodiment. Operation of the opening and flattening unit 138 is similar to that of the opening and flattening unit 38. More specifically, the leading end of the tube 34 is inserted into the opening and flattening unit 138 with the slit 36 at the bottom between the belt 167 and the first pressure roller 174. The belt 167 and the first pressure roller 174*a* cooperate to grip the edge of the tube 34 and pull the tube across the shoe 173. As the tube 34 is pulled across the shoe 173, the upper and lower spreading members 201, 202 cause the tube 34 to spread until an almost flat strip 39 leaves the opening and flattening unit 138.

Like the opening and flattening unit 38 of the first embodiment, the opening and flattening unit 138 is arranged for linear movement towards and away from the Conform extruder 33. For this purpose the opening and flattening unit 138 is mounted on linear bearings 181 which, in turn are mounted on a pair of spaced longitudinally extending rods 182. Control of movement of the opening and flattening unit 138 is accomplished in the same manner as that of the opening and flattening unit 38. A tension bar 184 under the control of an air cylinder 183 is mounted across the width of the frame 169 so as to apply a force to the belt 167 in the same direction as the extrusion direction.

Figure 14:
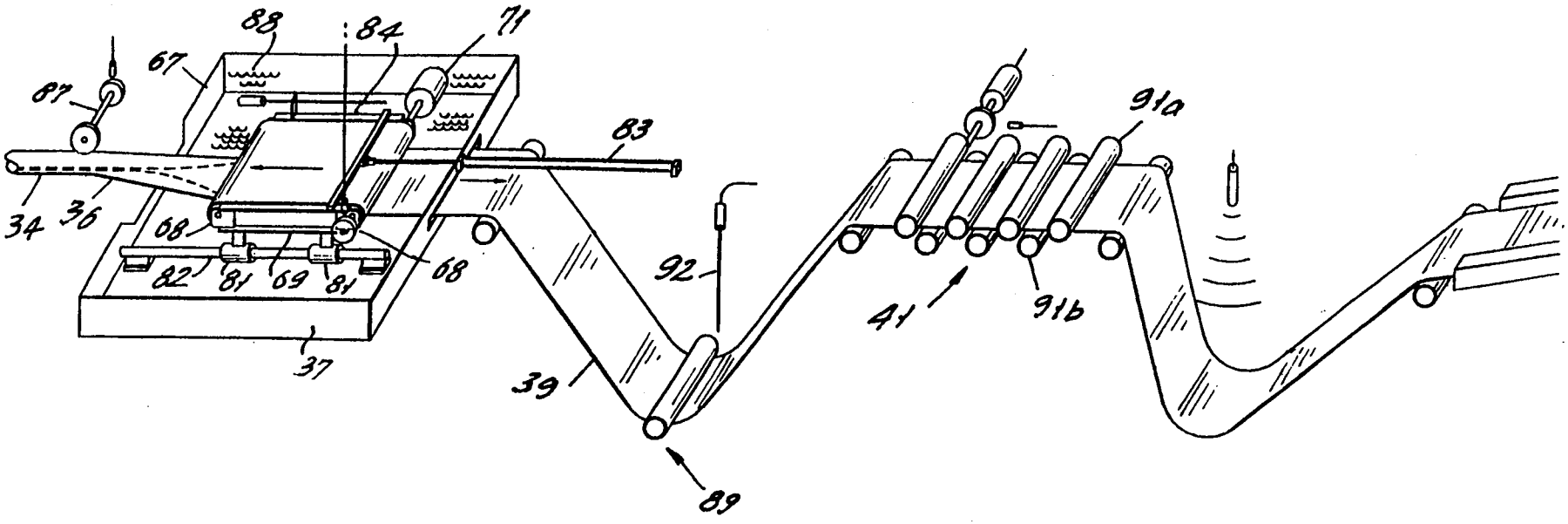
FIG. 14 is a diagrammatic view of the first embodiment of the opening and flattening station and a leveller used in the apparatus of FIGS. 3A and 3B.
Figure 16:
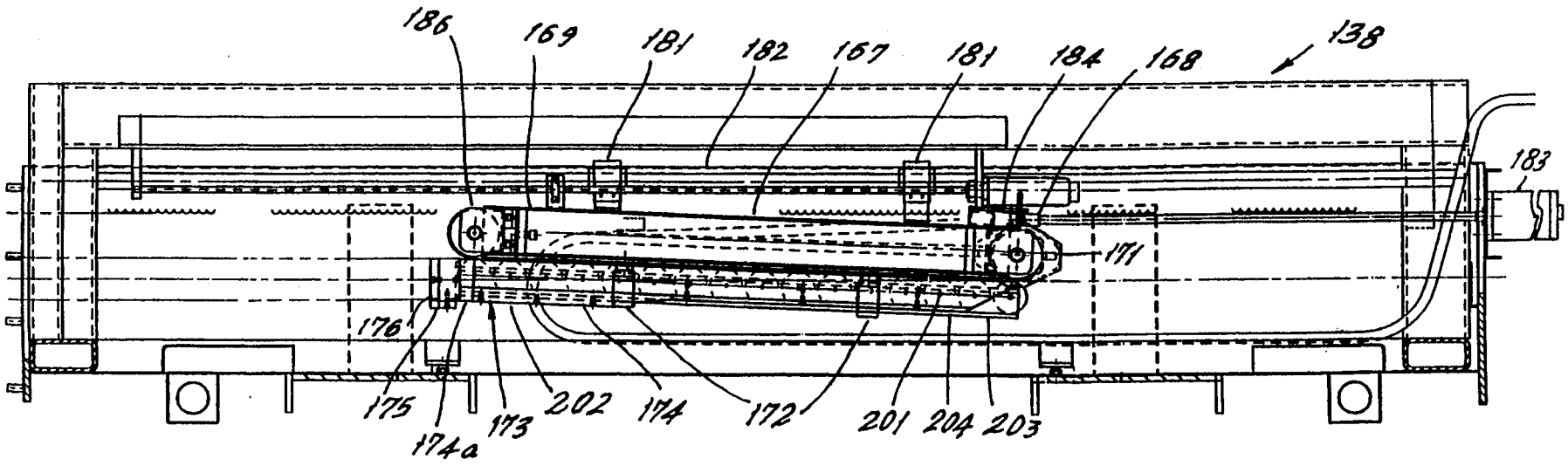

When the strip 39 leaves the opening and flattening unit 38 (or the opening and flattening unit 138) it may not be completely flat, but may have some curvature or "crossbow." As best seen in FIG. 14, to remove this curvature, the strip 39 is advanced to a leveller 41 which may be a commercially available 19 roll leveller available from Bruderer Machinery, Inc. The leveller 41 may include 9 rolls 91*a* above the horizontal (only some of which are shown) and 10 rolls 91*b* below (only some of which are shown). As is conventional, the upper rollers 91*a* are both longitudinally and laterally tiltable to remove camber or bend from the strip 39. Additionally, the rolls 91*a* and 91*b* are movable toward one another to increase or decrease their mesh as appropriate to eliminate any waviness of the strip 39. Other levellers having bending rollers may also be used and, indeed, such bending rollers may be particularly efficacious in removing waviness from the strip 39.

The leveller 41 is driven by a variable speed drive system including a variable speed motor and speed controller (not shown) so that its speed matches that of the rest of the line. A dancer assembly 89 (FIG. 3B) located between the opening and flattening unit 38 and the leveller 41 provides downward force on the strip 39 to help overcome curvature or crossbow in the strip and to keep the strip in a catenary loop. Suitable means, such as a magnetostrictive linear transducer 92 are provided to monitor the height of the catenary loop.

Referring back to FIG. 3B, after leaving the leveller 41, the strip 39 is coiled by the take-up system 42 including the mandrel 93. The take-up system 42 also includes edge guides 94 for guiding the strip 39 and tensioning pinch rolls 96 for tensioning the strip 39 during coiling to ensure tight, straight edged coils.

Additionally the apparatus may also advantageously include a conveyor 90 for inspection of the strip 39, a sensor 95 for measuring the height of the catenary loop between the leveller 41 and the take-up system 42, means (not shown) for initial threading of the billets 31 into the Conform extruder 33 and means (not shown) for gripping, cutting off and guiding the leading end of the tube 34 from the Conform extruder 33 into the opening and flattening unit 38. Suitable means (not shown) may also be provided for guiding the strip across the catenary loops during initial threading of the strip 39.

A significant aspect of the present invention is that the balanced flow of metal through the extrusion tooling 48 resulting from the twin groove feed of two billets 31 enables very straight edges 97 of the slit 36. That is, the edges 97 are essentially parallel to the longitudinal axis of the tube 34. This, in turn, enables a flat strip 39 having corresponding straight edges 97. Additionally, the strip 39 is formed with the edges 97 being contoured without the secondary metal treatment necessary in the prior art.

Additionally, keeping the diameter of the tube constant while varying the width of the slit to vary the width of the strip, allows use of the same production line (with only the extrusion tooling 48 changing) to produce strips 39 of different widths and thicknesses.

Unexpectedly, the electrical conductivity and 0-temper of the aluminum material is maintained during the process so that the electrical conductivity and 0-temper of the strip 39 is the same as that of the billets 31. This is unexpected because extrusion performed with prior art processes usually induces increased hardness and decreased electrical conductivity.

Figure 19:
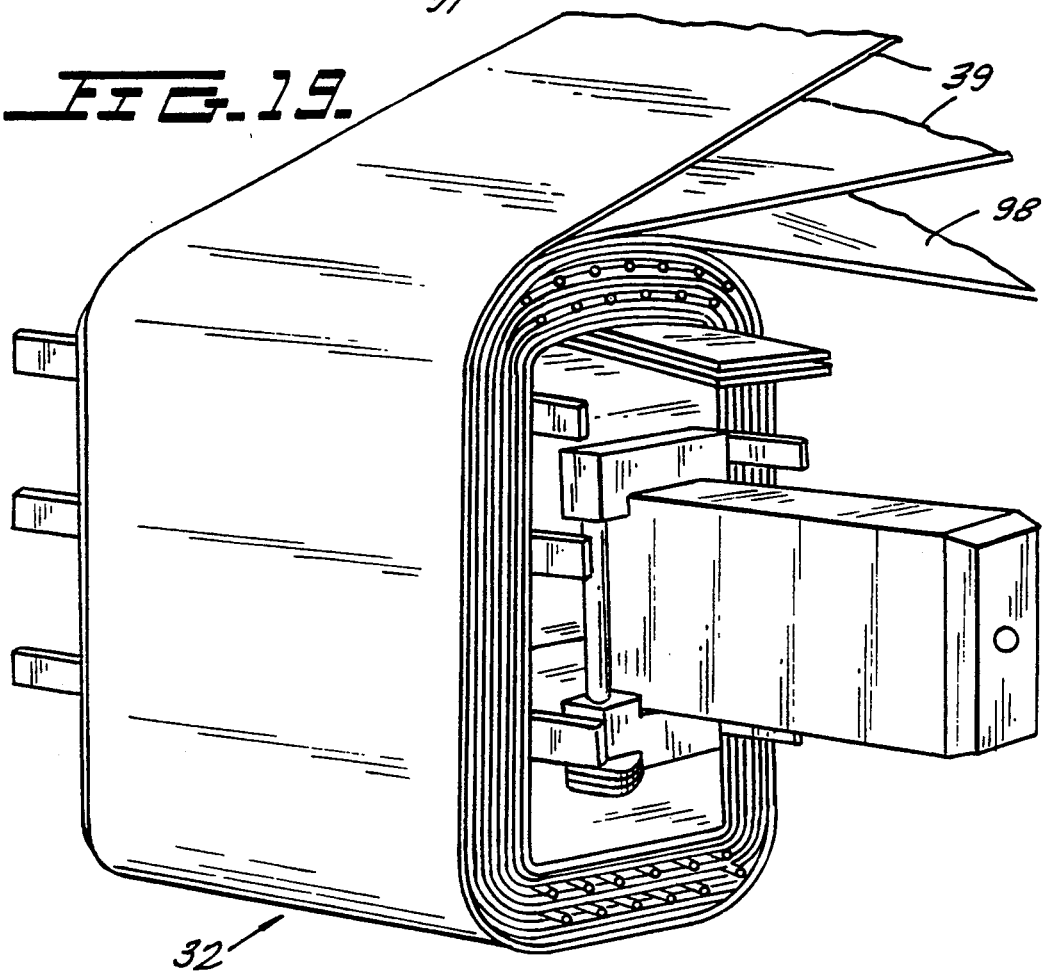
FIG. 19 is a perspective view of a power transformer coil being wound.

Referring now to FIG. 19, there is shown a power transformer coil 32 being wound. The coil 32 is continuously wound from the flattened strip 39. During winding, dielectric insulation 98 is wound between two layers of the strip 39. Because of the contoured edges 97, more reliable transformers 32 are possible. This is because any sharp edges on the strip 39 would concentrate the electrical field stress and create a point from which electrical corona can initiate insulation failure. Burrs which project above (or below) the surface plane of the strip 39 can cut through the insulation 98 during transformer service and result in shorting between turns with consequent transformer failure.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. Apparatus for opening and flattening an elongated tube having a longitudinal axis of symmetry, a diameter and a longitudinal slit in the circumferential wall thereof, which apparatus comprises:

an elongated forming member having an entrance end, an exit end, a longitudinal axis and a top surface, the entrance end having a width equal to or less than the diameter of the tube, the width of the forming member progressively increasing from the entrance end toward the exit end of the member; and means including a surface opposed to the top surface of the forming member for advancing the tube over the forming member, the forming member bending the tube outwardly in opposite directions at the slit to form the tube into a substantially flat strip with the forming member engaging the top surface of the tube to maintain the tube in contact with the top surface of the forming member.

2. Apparatus as defined in claim 1, wherein the means for advancing includes a movable belt.

3. Apparatus as defined in claim 2, wherein the forming member is mounted for movement toward and away from the direction of advancement of the tube.

4. Apparatus as defined in claim 3, wherein the means for advancing further includes a plurality of spaced rollers longitudinally disposed along the longitudinal axis of the member for engaging the bottom surface of the tube.

5. Apparatus as defined in claim 4, including means for applying a force to the belt so that a predetermined tension is applied to the tube.

6. Apparatus as defined in claim 5, wherein the longitudinal axes of the tube and the forming member are coaxial and wherein the exit end is located at the longitudinal axis of the forming member.

7. Apparatus as defined in claim 6, wherein the width of the forming member at the exit end is equal to the circumference of the tube.

8. Apparatus as defined in claim 7, further including a leveller for removing undulations and bow from the strip, said leveller including a plurality of upper rollers for engaging the top surface of the strip and a plurality of bottom rollers for engaging the bottom surface of the strip.

9. Apparatus as defined in claim 1, including a chamber for receiving a fluid, the elongated forming member being positioned in the chamber so that the fluid serves as a lubricant and coolant to aid in opening and flattening of the tube.

10. An apparatus for forming a continuous flat metal strip, comprising:

a rotatable wheel having first and second circumferential grooves;

means for feeding a first continuous rodlike billet to the first circumferential groove;

means for feeding a second continuous rodlike billet to the second circumferential groove;

a shoe mounted adjacent the wheel, the first and second billets being movable by the wheel through a passageway formed between the shoe and the wheel;

a die mounted adjacent the wheel, the die having an opening with a discontinuous, annular cross-section;

first and second abutments positioned to enter the first and second grooves, respectively, and to block movement of the billets through the passageway, the billets thereby being plasticly deformed and forced out of the grooves to the die opening, the deformed metal from both billets merging into the die opening, the merged metal flowing through the die and being formed into a continuous tube of circular cross section having a slit formed therein;

means for opening and flattening the tube by bending it outwardly in opposite directions at the slit to form a flat strip, the opening and flattening means comprising (i) an elongated forming member mounted for movement toward and away from the direction of advancement of the tube and having an entrance end, an exit end, a longitudinal axis which is coaxial with the longitudinal axis of the tube and a top surface, the entrance end having a width equal to or less than the diameter of the tube, the width of the forming member progressively increasing from the entrance end toward the exit end of the forming member, and the exit end being located on the longitudinal axis of the forming member and having a width equal to the circumference of the tube; and (ii) means including a movable belt having a surface opposed to the top surface of the forming member for advancing the tube over the forming member with the forming member engaging the top surface of the tube to maintain the tube in contact with the top surface of the forming member, the means for advancing further including a plurality of spaced rollers longitudinally disposed along the longitudinal axis of the member for engaging the bottom surface of the tube and means for applying a force to the belt so that a predetermined tension is applied to the tube;

a leveller for removing undulations and bow from the strip, said leveller including a plurality of upper rollers for engaging the top surface of the strip and a plurality of bottom rollers for engaging the bottom surface of the strip; and a chamber for receiving a fluid, the elongated forming member being positioned in the chamber so that the fluid serves as a lubricant and coolant to aid in opening and flattening of the tube.

11. Apparatus for opening and flattening an elongated tube having a longitudinal axis of symmetry, a diameter and a longitudinal slit in the circumferential wall thereof, which apparatus comprises:

means for opening and flattening the tube by bending it outwardly in opposite directions at the slit to form a flat strip, the opening and flattening means comprising (i) an elongated forming member mounted for movement toward and away from the direction of advancement of the tube and having an entrance end, an exit end, a longitudinal axis which is coaxial with the longitudinal axis of the tube and a top surface, the entrance end having a width equal to or less than the diameter of the tube, the width of the forming member progressively increasing from the entrance end toward the exit end of the forming member, and the exit end being located on the longitudinal axis of the forming member and having a width equal to the circumference of the tube; and (ii) means including a movable belt having a surface opposed to the top surface of the forming member for advancing the tube over the forming member with the forming member engaging the top surface of the tube to maintain the tube in contact with the top surface of the forming member, the means for advancing further including a plurality of spaced rollers longitudinally disposed along the longitudinal axis of the member for engaging the bottom surface of the tube and means for applying a force to the belt so that a predetermined tension is applied to the tube;

a leveller for removing undulations and bow from the strip, the leveller including a plurality of upper rollers for engaging the top surface of the strip and a plurality of bottom rollers for engaging the bottom surface of the strip; and a chamber for receiving a fluid, the elongated forming member being positioned in the chamber so that the fluid serves as a lubricant and coolant to aid in opening and flattening of the tube.

12. An apparatus for forming a continuous flat metal strip, comprising:

a rotatable wheel having first and second circumferential grooves;

means for feeding a first continuous rodlike billet to the first circumferential groove;

means for feeding a second continuous rodlike billet to a second circumferential groove;

a shoe mounted adjacent the wheel, the first and second billets being movable by the wheel through a passageway formed between the shoe and the wheel;

a die mounted adjacent the wheel, the die having an opening with a discontinuous, annular cross-section;

first and second abutments positioned to enter the first and second grooves, respectively, and to block movement of the billets through the passageway, the billets thereby being plasticly deformed and forced out of the grooves to the die opening, the deformed metal from both billets merging into the die opening, the merged metal flowing through the die and being formed into a continuous tube of circular cross section having a slit formed therein;

means for opening and flattening the tube by bending it outwardly in opposite directions at the slit to form a flat strip, the means for opening and flattening means comprising (a) an elongated forming member having an entrance end, an exit end, a longitudinal axis and a top surface, the entrance end having a width equal to or less than the diameter of the tube, the width of the forming member progressively increasing from the entrance end toward the exit end of the member; and (b) means including a surface opposed to the top surface of the forming member for advancing the tube over the forming member with the forming member engaging the top surface of the tube to maintain the tube in contact with the top surface of the forming member.

13. Apparatus as defined in claim 12, further including:

(a) a leveller for removing undulations and bow from the strip, said leveller including a plurality of upper rollers for engaging the top surface of the strip and a plurality of bottom rollers for engaging the bottom surface of the strip; and (b) a chamber for receiving fluid, the elongated forming member being positioned in the chamber so that the fluid serves as a lubricant and coolant to aid in opening and flattening of the tube.

14. Apparatus as defined in claim 12, wherein the means for advancing includes a movable belt.

15. Apparatus as defined in claim 14, wherein the forming member is mounted for movement toward and away from the direction of advancement of the tube.

16. Apparatus as defined in claim 15, wherein the means for advancing further includes a plurality of spaced rollers longitudinally disposed along the longitudinal axis of the member for engaging the bottom surface of the tube.

17. Apparatus as defined in claim 16, further including means for applying a force to the belt so that a predetermined tension is applied to the tube.

18. Apparatus as defined in claim 17, wherein the longitudinal axes of the tube and the forming member are coaxial and wherein the exit end is located at the longitudinal axis of the forming member.

19. Apparatus as defined in claim 18, wherein the width of the forming member at the exit end is equal to the circumference of the tube.

20. Apparatus as defined in claim 19, further including a leveller for removing undulations and bow from the strip, said leveller including a plurality of upper rollers for engaging the top surface of the strip and a plurality of bottom rollers for engaging the bottom surface of the strip.

* * * * *